United States Patent [19]

Sivachenko et al.

[11] 3,940,965

[45] Mar. 2, 1976

[54] METHOD AND APPARATUS FOR FORMING CORRUGATING PIPE

[75] Inventors: Eugene W. Sivachenko, Redding; Howard G. Pratt, Brownsville, both of Calif.

[73] Assignee: Eugene Sivachenko, Redding, Calif.

[22] Filed: Mar. 6, 1975

[21] Appl. No.: 555,918

Related U.S. Application Data

[63] Continuation-in-part of Ser. No. 478,561, June 12, 1974, abandoned.

[52] U.S. Cl. ..... 72/180; 72/50

[51] Int. Cl.[2] ..... B21C 37/12; B21D 5/06

[58] Field of Search ..... 72/180, 181, 177, 50, 49, 72/179

[56] References Cited

UNITED STATES PATENTS

| | | | |
|---|---|---|---|
| 726,691 | 4/1903 | Johnson | 72/180 |
| 2,282,176 | 5/1942 | Fay et al. | 72/49 |
| 2,638,143 | 5/1953 | Maust | 72/165 |
| 2,747,642 | 5/1956 | Kuettel | 72/181 |
| 3,677,047 | 7/1972 | Holyoak et al. | 72/50 |
| 3,750,439 | 8/1973 | Pratt | 72/49 |

*Primary Examiner*—Milton S. Mehr

*Attorney, Agent, or Firm*—Townsend and Townsend

[57] ABSTRACT

A corrugated pipe forming apparatus and method in which flat sheet metal is passed through a plurality of first and second opposite roller pairs and deformed into a corrugated sheet. Lateral lips are formed parallel to the edges of the sheet and extend generally perpendicular to the sheet over the full length thereof. A pipe rolling machine helically deforms the corrugated sheet and folds the lip into a mechanical lock seam defining Pittsburgh lock of predetermined dimensions and tolerances. To maintain such dimensions and tolerances the width of the lips is adjusted by simultaneously moving one roll of each set in identical increments towards and away from the other roll of each set to thereby correspondingly change the depth of the corrugations and the width of the lips. The sheet can be moved laterally to maintain the lips of equal width. Corrugating stations of the device are defined by opposed corrugating rollers with the upper rollers held on a first frame and the lower rollers held on a second frame. Each frame includes opposite and rigid sides interconnected by fixed rigid axles. Opposed upper and lower rollers are journaled at their respective ends about each of the respective axles.

19 Claims, 16 Drawing Figures

METHOD AND APPARATUS FOR FORMING CORRUGATING PIPE

RELATED APPLICATIONS

This application is a continuation-in-part application of the co-pending patent application, Ser. No. 478,561, filed June 12, 1974 for CORRUGATING MILL, now abandoned.

BACKGROUND OF THE INVENTION

This invention relates to roller mills and more particularly to a corrugated pipe forming machine having a corrugating roller mill of the type having upper and lower opposed corrugating rollers for manufacturing the pipe from flat sheet metal.

Corrugating pipe is presently in wide use because of its relatively high strength and low cost. Since such pipe is normally buried its appearance is of secondary consideration and most tolerances of the pipe are loose which further contributes to the economy of such pipe.

A stringent requirement of such pipe, however, is that it be structurally sound. Since the pipe is almost always formed by helically winding a continuous length of corrugated sheet structural soundness usually hinges upon the formation of a high strength seam as the sheet is helically wound. Seams can be formed by welding the edges of the metal or by forming a mechanical interlock, also called a Pittsburgh lock. The mechanical lock is formed by first rolling a longitudinally extending edge lip on the corrugated sheet which extends generally perpendicular to the remainder of the sheet. As the sheet is helically wound, the edge lips are overlapped and folded over to form the lock. Tight tolerances in the dimensioning of the lip must be maintained. The width of the lips must be within plus or minus one thirty-second of an inch and both lips must be of equal width. Since the lips are formed by laterally disposed edge forming rolls the sheet must therefore be precisely centered relative to such rolls. Moreover, the overall width of the sheet must be closely controlled to maintain the desired lip dimensions and tolerances.

Given this requirement and the need for multiple corrugating rolls, in which each corrugating station is defined by a pair of opposed rollers which progressively form the corrugations from the center towards the sheet edges, the prior art has developed so-called line formers in which the corrugating stations are separate and independent so that each station must be adjusted individually. Such individual adjustment enables one to precisely align the corrugations in the sheet with the edges and to generally produce a high quality corrugated sheet. This is of great importance when the corrugated sheet is used for covering roofs, sidewalls, etc. It is relatively insignificant when the corrugated sheet is subsequently deformed, as on a helical corrugated pipe rolling machine since misalignments of individual sheet corrugations relative to each other or relative to the sheet edges become undetectable due to the general stretching and deformation of the sheet when it is wound. The overall sheet width and/or the absolute and relative dimensions of the edge lips, however are of the utmost importance and must fall within specified dimensions and tolerances.

Prior art corrugated pipe forming machines apparently never recognized this distinction, or gave no importance to it, and employed line formers constructed of a plurality of independent corrugating stations. Since the effective width of the sheet, and therewith the effective dimensions and tolerances of the edge lips is a function of and can be varied with variations in the depth of the corrugations, any adjustment required an adjustment of all corrugating stations. This was time-consuming and required highly skilled, and therefore, expensive labor. Moreover, since the independent corrugating stations are spaced relatively far apart, a substantial length of sheet material must be run through the corrugator before the final dimension can be taken and before it can be determined whether or not the adjustments were sufficient or accurate. If not, the length of sheet metal just run through the corrugator is wasted and must be discarded. In prior art pipe rolling machines present in extensive use, wastage could amount to as much as 24 feet for each dimension check.

Thus, it may be summarized that prior art corrugated pipe forming machines employed sheet metal corrugators which yielded high accuracy in an area where accuracy is of little importance, namely, the alignment of the corrugations relative to each other and relative to the sheet edges. However, such corrugators made it difficult, time-consuming, and therefore, expensive to attain and maintain accuracy where it counts, namely, in the dimensioning and the tolerances of the edge lips which subsequently form the continuous pipe seam.

The corrugators employed with prior art pipe rolling machines have included at least three additional specific disadvantages.

A first disadvantage of the prior art is that each of the opposed rollers has heretofore been mounted on journals, which journals are individually adjustable. It is known that corrugation requires precise and equal adjustment between sequential corrugating rollers. The individually adjustable rollers of the prior art make such adjustment difficult, at best, and only capable of achievement by mechanics of relatively high skill.

Moreover, this problem is often compounded by the sheet metal or skelp being processed. Varying thickness of skelp found either from roll to roll or even in different segments of the same roll requires different adjustments. Where individual adjustment of individual rollers is required, loss of time and loss of unsatisfactory corrugated skelp results.

Second, the drive of the sequential rollers has presented a problem. The fact that opposed rollers must be adjustable towards and away from one another has compounded this problem. Specifically, either chain drives or idler gear drives between adjacent rollers have been used.

Where chain drives have been used, the chain is commonly wound so as to drive each and every roller. The result is that the chain of the drive must be of a thickness to transmit the power to drive all rollers. Extreme chain bulk and cost results. Moreover, increased sprocket size is frequently required to reduce chain thickness to tolerable limits. The sprockets which, of necessity, must be in line, are further spaced apart. The individually powered rollers must be further apart resulting in a longer mill. Increased machine length results in increased difficulty of adjustment and increased scrap loss where insufficiently corrugated skelp is produced — especially during machine adjustment.

Moreover, idler gear drives have extreme disadvantages. Primarily, idler gears are expensive mechanisms which complicate machinery in which they are used as to numbers of moving parts and maintenance. Additionally, and more seriously, the number of rollers which can be driven from an individual power source through an idler gear drive chain is limited. Where more than four rollers are all driven off of the same torsional power input through idler gears, gear bulk — either in length or diameter — must be increased dramatically.

Finally, such roller mills have, in the past, included corrugated rollers which comprise short and discrete cylindrical sleeves which are placed as segments over underlying rigid and rotating shafts. The corrugating rollers at the sleeve segments provide no part of the considerable rigidity required for corrugation by opposing rollers. As a result, the rotating and underlying shafts and journals have to be of a relatively large diameter. Correspondingly, the discrete roller segments for corrugation have to be of even a larger diameter. As a consequence, at least the thickness and the length of such machines must be of relatively large dimension with corresponding increased cost of machine fabrication and operation.

SUMMARY OF THE INVENTION

The present invention generally provides an improved corrugator especially adapted for use in connection with corrugated pipe forming machines which helically wind a flat corrugated sheet into cylindrical pipe. One of the broader aspects of the present invention contemplates to form a mechanical interlock to seam the helically wound corrugated sheet and to provide a corrugator which can be readily and quickly adjusted without generating large amounts of waste to maintain the edge lip dimensions and tolerances within stated limits. A continuous, trouble-free operation of the pipe rolling mechanism and a high quality finished corrugated pipe having maximum strength is thus assured.

Generally, this is achieved by intermittently changing the width of the corrugated sheet and, thereby, the width of the edge lips to compensate for deviations caused by irregularities or dimensional changes in the flat sheet. This is done by simultaneously and identically moving one roller of each set of opposing corrugating rollers towards and away from the other roller to thereby correspondingly change the depth of the corrugation, the effective overall width of the sheet, and most importantly, the width of the edge lips. Moreover, the present invention contemplates to laterally move the flat sheet upstream of the corrugating stations to maintain the widths of the lips equal.

Generally, a corrugator constructed in accordance with the invention comprises a plurality of cooperating sets of first and second corrugator rollers through which the sheet passes and first and second roller mounting means for immovably interconnecting all first rollers of the sets and all second rollers of the sets. The mounting means permit the rollers to rotate about their axis. Means is provided for moving the first and second mounting means towards and away from each other to thereby move the roller pairs of each set toward and away from each other for adjusting the depth of corrugations formed in the sheet. The roller mounting means preferably comprise frames which can be moved towards and away from each other by operating a single actuator which is operatively connected with multiple spaced apart points of the frame.

Thus, with a single adjustment all rollers are simultaneously and identically moved towards and away from each other to adjust the final width of the corrugated sheet and therewith the width of the edge lips. Such adjustment is simple, requires little skill and time and is, therefore, substantially less expensive than the necessary adjustments on prior art line formers having multiple independent corrugating stations.

Although the arrangement of the present invention does not permit an individual adjustment of the corrugating stations, that is one station cannot be raised or lowered a greater or lesser amount than another station which, at times may result in slight irregularities in the positioning or alignment of the corrugations with respect to each other and/or with respect to its edges, such irregularities are of no particular concern when the corrugated sheet is thereafter helically deformed into a corrugated pipe. The irregularities are not visible to the eye and they do not interfere with either the pipe forming operation or the utility of the finished pipe as long as the sheet width and edge lip dimensions and tolerances are maintained. Thus the corrugator of the present invention is economical and simple.

Thus, when the corrugator of the present invention is combined with helical pipe forming machinery it represents a great improvement over the prior art and will result in substantial cost savings in manufacturing corrugated pipe.

To fully accomplish the above-stated objectives of the present invention, it is also highly desirable to maintain the widths of the edge lip equal. Slight irregularities or changes in its chemical or metallurgical structure may from time to time cause misalignments of the sheet relative to the edge lip forming rollers. To counteract such misalignments and to maintain the edge lip widths equal, lateral adjustment rollers are positioned upstream of the corrugators. The adjustment rollers can be actuated to center the sheet by moving it in a lateral direction. The adjustment rollers can be actuated via suitable controls operatively coupled to a monitoring device which continuously senses both the absolute width of the edge lips and their relative width. In one embodiment of the invention the monitoring device may further be operatively coupled with automatic means for operating the actuator which raises or lowers the corrugating rolls to maintain the desired overall sheet width and, therewith, the lip width and tolerance.

More specifically, the corrugator of the present invention contemplates the use of upper corrugating rollers which are held on a first frame; and lower corrugating rollers which are held on a second frame. Each frame includes opposite and rigid sides interconnected by fixed rigid axles or rungs. Opposed upper and lower rollers are journaled about each of the respective axles, at their respective ends. The rollers, of solid and continuous cylindric sidewall construction to their full length, have an improved bending strength and a correspondingly reduced dimension. An improved drive of adjacent pairs of lower rollers is provided through shafts journaled between the lower rigid frame sides. These shafts, through gearing, drive on either side lower corrugating rollers through gearing. The upper opposed rollers are in turn driven by their lower opposed rollers. These upper rollers are driven directly by low tolerance, high backlash gears between the upper and lower rollers that enable towards and away adjustment of the upper and lower rollers while meshing and driving contact of the gears is maintained. The interstitial distance between the upper and lower rollers is produced by four interlinked screw adjustments to provide precisely identical upper and lower roller corrugating adjustments with a minimum of operator or mechanic attention. Rollers for providing a lock seam at the end of the machine are provided with individual adjustability.

OTHER OBJECTS AND ADVANTAGES OF THE INVENTION

An object of this invention is to include an improved frame support for opposed upper and lower roller stations. According to this aspect of the invention, the improved rollers of this invention are each journaled about rigid and solid shafts. The rigid and solid shafts are securely fastened to side frames. The result is that the upper rollers are rigidly held, and the lower rollers are separately rigidly held.

An advantage of this aspect of the invention is that by precise adjustment of the upper and lower roller holding frames towards and away from each other, corresponding precise and equal adjustment of all opposing upper and lower rollers of the mill may occur. Moreover, adjustment can occur during machine operation.

Yet another object of this invention is to provide for precise and simultaneous adjustment of all rollers in a given mill. According to this aspect of the invention, threaded adjustment screws are provided at four symmetric locations between the upper and lower frames. Typically, two spaced threaded adjustments are provided at the forward end of the frame, and two spaced threaded adjustments are provided at the after end of the frame. By the expedient of gearing all of the threaded adjustments together, precise and equal adjustment of all roller stations along the entire length of the two opposing frames can occur.

An advantage of this aspect of the invention is that laborious and skilled individual adjustment of each roller station on its own bearings is not required.

A further advantage of this roller adjustment aspect of the invention is that minor variations in skelp dimension can be swiftly and easily accommodated. Loss of time and wastage of skelp is reduced, if not eliminated.

Yet another object of this invention is to disclose an improved roller drive between individual upper and lower opposed rollers. According to this aspect of the invention, high backlash low tolerance gears are used to provide a direct gear drive between upper and lower gears while at the same time permitting individual adjustment of the gears towards and away from one another.

An advantage of the direct gear drive between the upper and lower rollers is that chain drives interlinking all rollers or more complex idler gear drives are avoided. Simplicity of the drive results.

A further object of this invention is to disclose a drive for sequential opposed rollers — typically exceeding four in number. According to this aspect of the invention, adjacent lower roller pairs are driven by a single power input shaft placed in the interstitial area between paired lower rollers. The single power input shaft can in turn be driven by an enlarged sprocket or gear overlapping the elevational and horizontal spatial interval occupied by at least two adjacent roller stations. The sprocket or gear can in turn be linked directly to the power source.

An advantage of the improved drive is that power inputs to the sequential rollers can occur at any number of stations along the mill. Gear bulk or chain bulk is reduced and mechanical advantage is increased in a mill of short length.

A further object of this invention is to disclose an improved apparatus for placing a lock seam in corrugated skelp. According to this aspect of the invention, opposed rollers for forming a lock seam are made individually adjustable off of the opposed individually adjustable rigid frames of the corrugating mill.

An advantage of this aspect of the invention is that the precision adjustment required for forming a Pittsburgh lock is independent of adjustments to the corrugating mill. As a result, the Pittsburgh lock — crucial in forming corrugated pipe — can be adjusted independently and with precision.

Yet another object of this invention is to disclose a corrugating roller machine wherein the rollers are of minimal dimension. According to this aspect of the invention, each roller is cylindrically shaped and contoured to provide the desired corrugation. The rollers are given a minimal sidewall thickness and diametric dimension to fully resist bending. By the expedient of independently journaling each of the cylindric rollers at their respective ends to a concentric rigid shaft, minimal roller diameter is required.

An advantage of this aspect of the invention is that sequential rollers can be spaced in close side-by-side relation. The result is a machine of minimal length.

Yet another aspect of the roller dimension of this invention is that the corresponding upper and lower opposing halves of the roller mill are all provided with minimal thickness. Consequently, minimum thickness of the roller mill results.

An advantage of the minimum length and thickness is a line mill for corrugation which is small enough to be readily portable.

A further advantage of the rollers here disclosed is that the gear for driving the rollers can be formed integrally with the rollers. Further reduction in overall machine construction and maintenance cost can result.

A further advantage of the cylindrical rollers of this invention is that large bearings may be used to journal the rollers. Likewise, special housings for mounting bearings are not required.

Other objects, features and advantages of this invention will become more apparent after referring to the following specification and attached drawings in which.

DESCRIPTION OF THE PREFERRED EMBODIMENTS

Figures 1, 4:
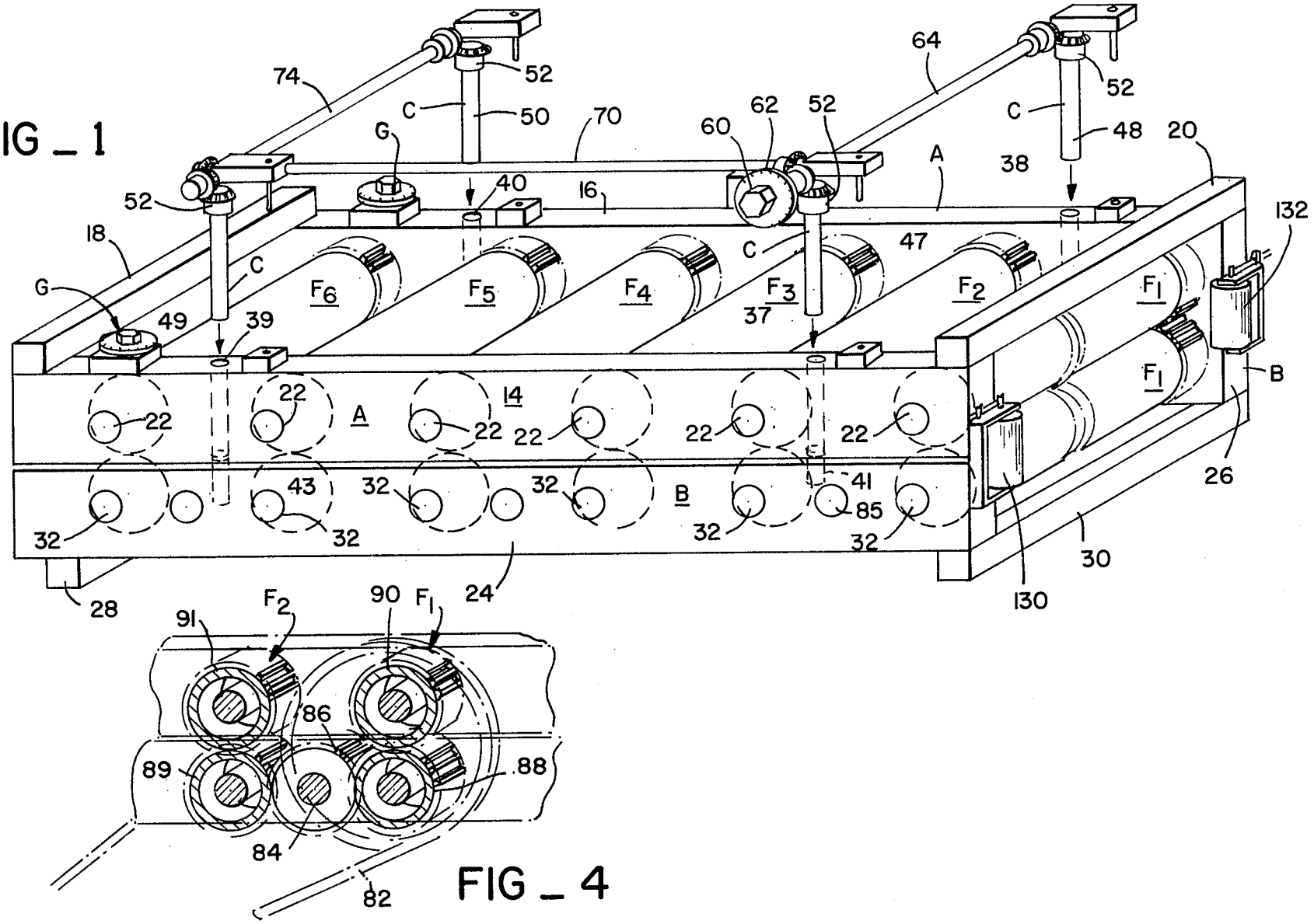
FIG. 1 is a perspective view of the improved rolling mill of this invention.
FIG. 4 is a schematic illustrating specifically the drive of paired opposed roller stations on opposite sides of a single power input.
Figures 2, 3, 5:
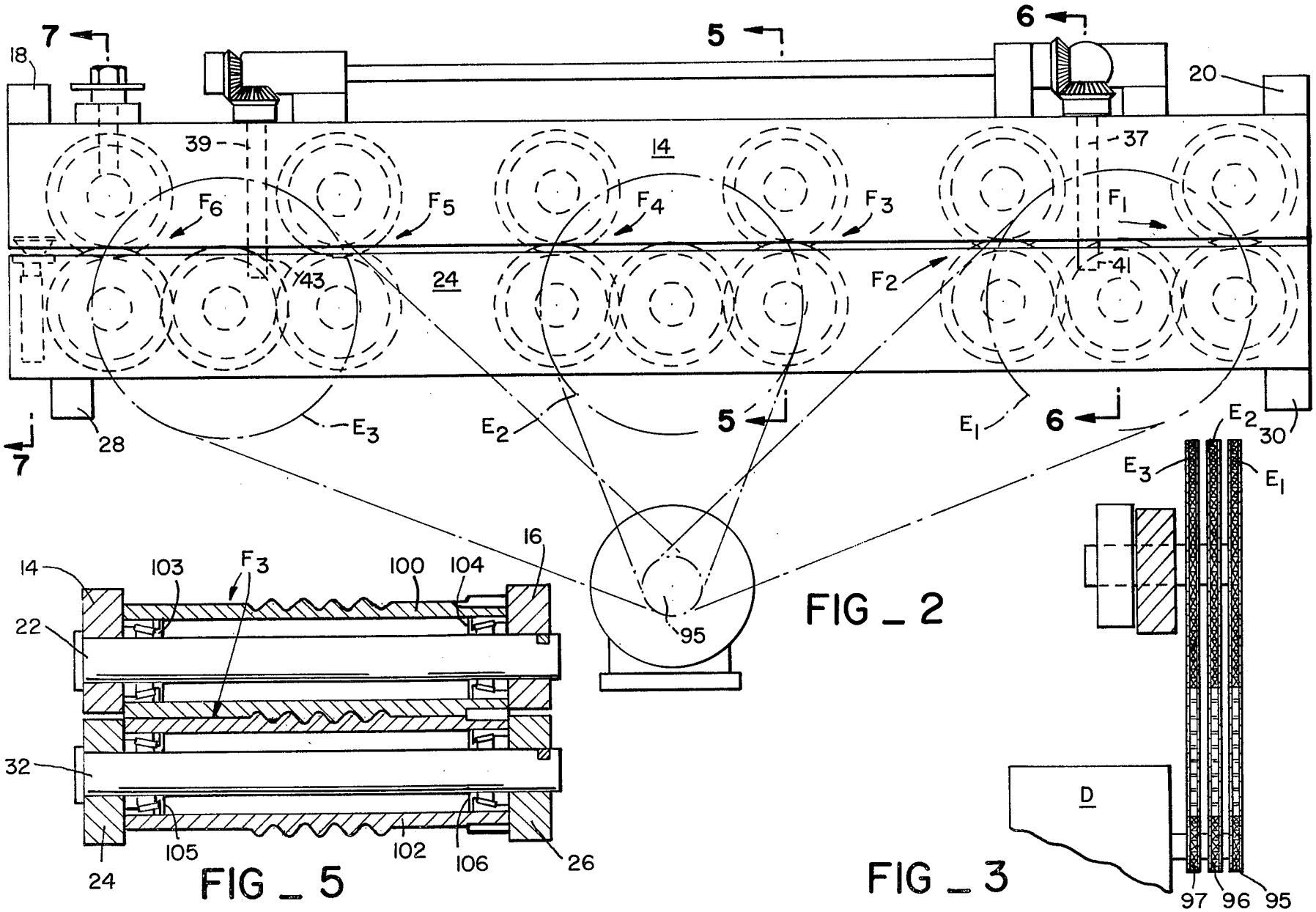
FIG. 2 is a side elevation of the rolling mill of this invention used as a reference point for FIGS. 5, 6 and 7 as well as a schematic representation of the improved drive of this invention.
FIG. 3 is an end elevation of the motor and sprocket drive illustrating the individual power inputs to opposed roller pairs of this invention.
FIG. 5 is a cross section taken along lines 5—5 of FIG. 2 illustrating the cylindric roller construction of this invention wherein the forming rollers are provided with a cylindrical diameter over their entire length to reduce roller dimension and provide improved bending strength.
Figure 9:
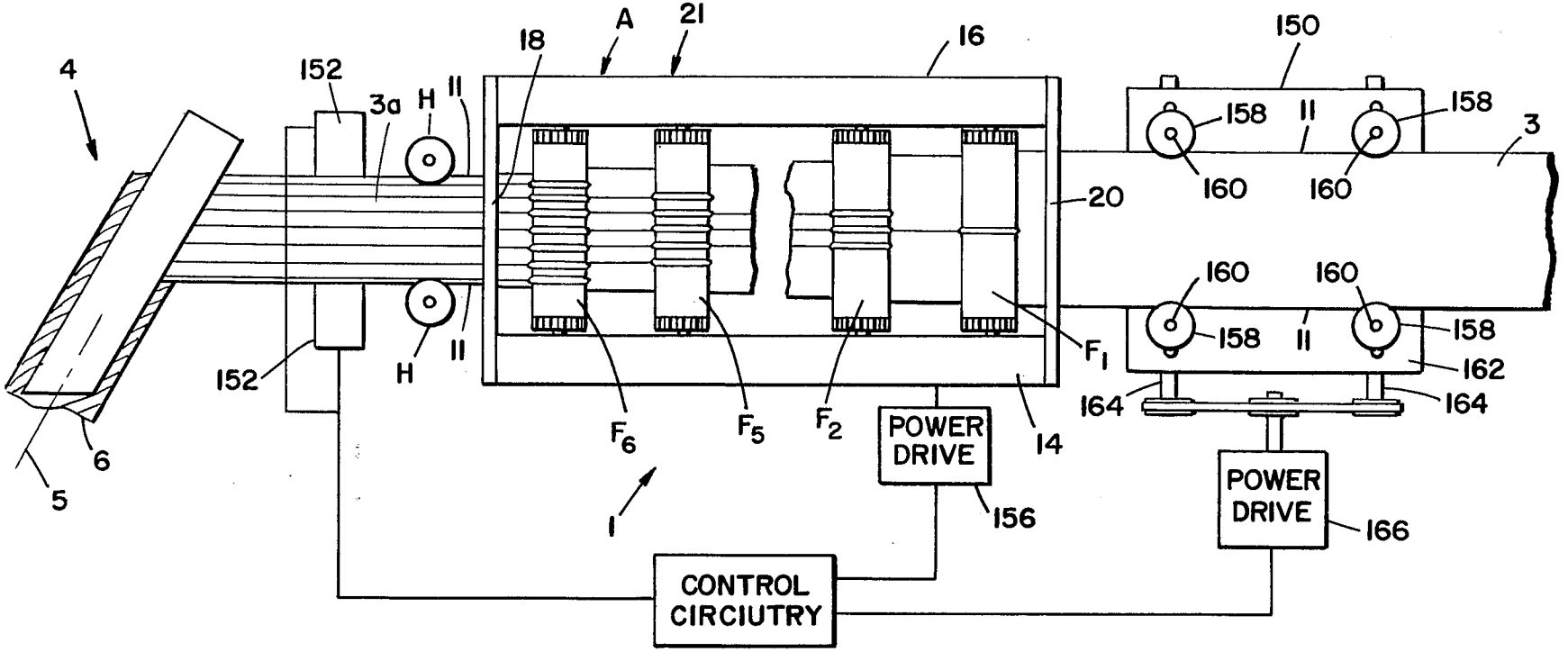
FIG. 9 is a schematic plan view of a pipe forming machine constructed in accordance with the present invention.

Referring to FIGS. 1 and 9, a pipe forming machine, generally comprises a corrugator 1 for longitudinally corrugating a flat sheet 3, and a pipe rolling station 4 where the corrugated sheet 3*a* is helically wound about an axis 5 into a corrugated pipe 6. The corrugator has an upper roller frame A and a lower roller frame B are shown individually adjustable towards and away from one another by four adjustment screws C all geared together. Referring briefly to FIGS. 2 and 4, a single motor D drives individual sprockets $E_1$–$E_3$ to power opposed rollers $F_1$–$F_6$. Individual adjustment G of roller $F_6$ is provided for the roller station forming the Pittsburgh lock in the corrugated skelp.

Figure 11:
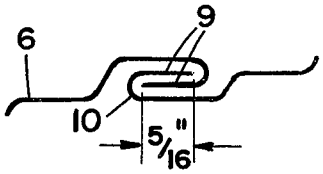
FIG. 11 is a fragmentary, schematic cross-sectional view of a finish formed seam of a corrugated pipe formed by helically winding the corrugated strip illustrated in FIG. 10.
Figure 10:
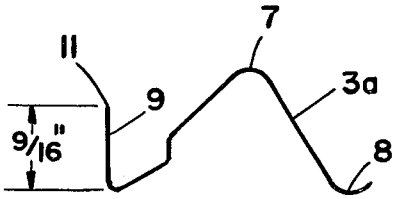
FIG. 10 is a fragmentary, schematic cross-sectional view of a lateral end of a finish formed corrugated sheet just prior to its helical deformation into pipe.

In operation and as specifically illustrated in the sequential illustration of FIGS. 8A–8F and in FIGS. 10 and 11, uncorrugated sheet or skelp 3 is introduced sequentially to pass from opposed rollers $F_1$ to opposed rollers $F_6$. Corrugation starting from the center and working outwardly towards and sides along a parallel corrugation occurs at rollers $F_1$ through $F_4$. The finish corrugated sheet 3*a* is defined by a plurality of alternating peaks and valleys 7 and 8, respectively, and by longitudinally running edge lips or sections 9 which extend generally perpendicular to the sheet. Upon winding of the corrugated sheet at roller station 4, the adjacent sections are overlapped and pressed together to form a mechanical or Pittsburgh lock 10 which defines the continuous, corrugated pipe seam. The Pittsburgh lock is formed by rollers $F_5$, $F_6$ and by vertical axis rollers H.

The formation of the pipe seam is critical. The overlap of edge lips 9 must be within close tolerances. For commonly used corrugated pipes of 12 inches in diameter and larger the overlap is frequently specified as being five-sixteenths inch. If the tolerance is exceeded, the bulk of the lips cannot be accommodated. This leads to an incompletely formed seam which opens when subjected to a load. On the other hand, if the lower end of the tolerance is exceeded there is an insufficient overlap so that the seam might open due to relatively small longitudinal movements of the helically wound corrugated pipe strips during transportation, installation or in use. In either event the pipe must be rejected.

To assure a dimensionally accurate seam, say the abovereferenced five-sixteenths inch seam, the edge lips must have a length of nine-sixteenths inch, plus or minus one thirty-second inch as indicated in FIG. 10. Since the last step in the corrugating process is the step of turning the lip upwardly, as seen in FIG. 10, the overall width of the corrugated sheet, measured from sheet edge 11 to sheet edge 11 must be closely controlled, normally within plus or minus one thirty-second inch. Commercially available flat stock, however, has a width tolerance well in excess of one thirty-second of an inch. Depending on the quality of the stock, the tolerance may be as much as plus or minus one-fourth inch or more. To compensate for such tolerances, therefore, the effective lateral sheet width must be closely controlled. This can be done by increasing or decreasing the depth of the corrugations.

Referring to FIGS. 1 and 9 through 11, the present invention employs corrugator 2 for effecting the control of the overall sheet width. To efficiently vary the depth of the corrugations all upper corrugating rollers are rigidly interconnected, that is, their relative position is fixed and they are not individually adjustable in either a vertical or horizontal direction. Similarly, the lower rollers of each pair are rigidly interconnected and fixed with respect to each other. Consequently, the corrugation depth is readily controlled and varied by simply moving one or the other of the fixedly interconnected rollers towards or away from the opposing rollers. The construction of upper and lower frame A and B can be readily understood. Referring to frame A, it includes paired rigid sides 14, 16. These rigid sides are connected at their respective ends by bars 18, 20. Additionally, each upper roller is journaled on a shaft 22. Rigid shafts 22 extend from side to side of the machine and rigidly spaced apart sides 14, 16.

The construction of the lower frame B is analogous. Sides 24, 26 are held in spaced apart relation by bars 28, 30. A series of rigid shafts 32 on which each of the lower rollers is journaled additionally interconnects sides 24, 26 (see FIG. 5). It is thus seen that the frames A, B between their respective sides 14, 16 for frame A, and sides 24, 26 for frame B, through their respective interconnection by rigid shafts 22 for frame A, and 32 for frame B, are precisely analogous to ladders.

Thus, the shafts 22 and 32 of the upper and lower frames A, B, and therewith rollers $F_1$ to $F_5$ are rigidly interconnected and cannot be individually moved or adjusted. However, these sections defined by the respective frames and the associated shafts are movable towards and away from one another to simultaneously and identically adjust all opposed rollers $F_1$–$F_6$ for reasons fully set forth below roller pair $F_6$ is additionally independently adjustable.

Figure 6:
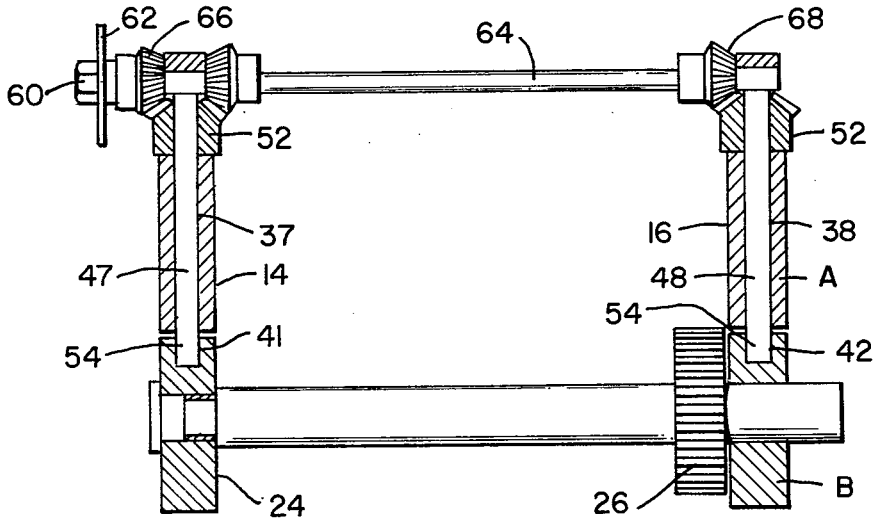
FIG. 6 is a section taken along lines 6—6 of FIG. 2 illustrating two of the tensioning members between the upper and lower rigid frames for providing simultaneous adjustment to all of the corrugating rollers of this invention through a single manipulation.
Figure 7:
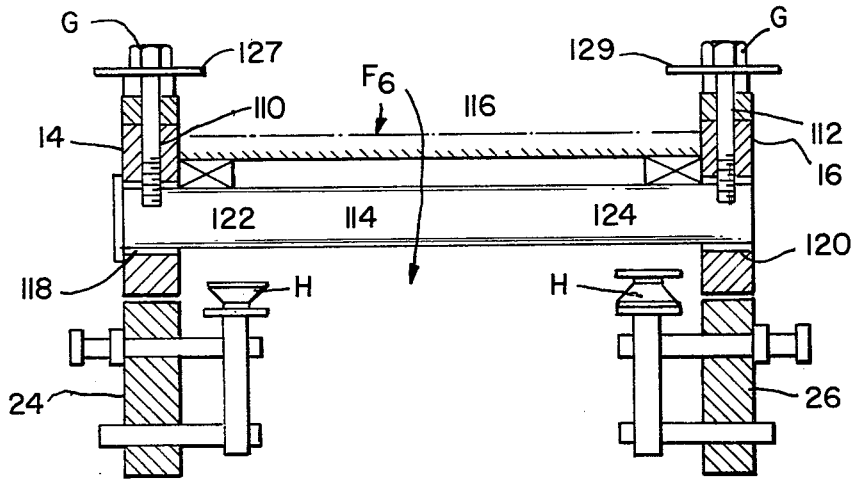
FIG. 7 is a side elevation taken along lines 7—7 of FIG. 2 illustrating the individual adjustment of the rollers providing the lock seam.
Figure 8A:
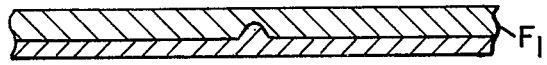
FIGS. 8A–8F are partial cross sections of the rollers of this invention at the point where they are contiguous to illustrate their respective shapes for sequentially corrugating and forming skelp with a lock seam therein.
Figure 8B:
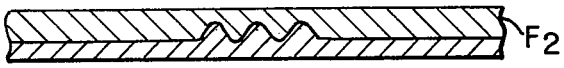
Figure 8C:
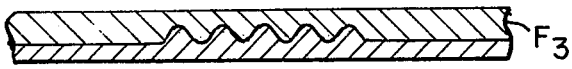
Figure 8D:
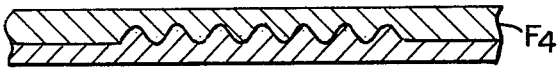
Figure 8E:
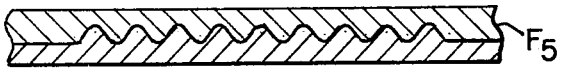
Figure 8F:
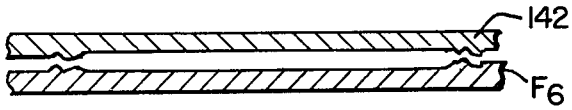

Regarding this simultaneous adjustment and referring to FIGS. 1, 2 and 6, the adjustment may be readily understood. It will be seen that between rollers $F_1$ and $F_2$, and rollers $F_5$ and $F_6$ frame A is transpierced by apertures 37–40. Apertures 37–40 are unthreaded.

At corresponding locations, frame B is tapped at threaded apertures 41–44 (tapped aperture 44 not being visible in the views here shown).

Adjustment of the frame members A, B towards and away from one another is provided by shafts 47–50. Each of these shafts is provided with a bevel gear assembly 52 at the upper end, and with threads 54 at the lower end. As can be seen by quick reference to FIGS. 1 and 6, simultaneous and identical turning of shafts 47–50 will cause the threads 54 to move inwardly and outwardly of the respective tapped apertures 41–44 and cause frame A to move towards and away from frame B by capture of frame A between each bevel gear assembly 52 and frame B.

Again referring to FIGS. 1 and 6, the simultaneously and identical rotation of shafts 47–50 can be easily understood. An adjustment bolt 60 with an attached scale 62 rotates shaft 64. Shaft 64, through bevel gears 66, 68, imparts rotation to shafts 47, 48, the rotation here shown being identical because of identical bevel bear ratios. Bevel gear 52, attached to shaft 47, in turn rotates a longitudinal shaft 70 which, through suitable bevel gear arrangements, rotates bevel gear 52 of shaft 49 to produce similar identical rotation. By a shaft arrangement 74, analogous to shaft 64, bevel gear 52 of shaft 50 likewise imparts to identical rotation shafts 49, 50. The result is that by adjusting a single nut 60, frames A and B at four symmetrical spaced points can be simultaneously and identically adjusted towards and away one from another.

To produce the machine here shown, it has only been necessary to provide four shafts for towards and away adjustment of the respective frame members. Where the frame members are longer, more shafts with identical gearing can be provided. It should also be noted that bevel gears 52 are enlarged and that the corresponding bevel gears attached to the shafts 64, 70 and 74 are small. This permits drive of the bevel gears 52 from the shafts to occur while preventing the intermeshing of the bevel gears between the respective shafts 64, 70, 74.

Having set forth the adjustment of member C, the drive of the rollers F from motor D through sprockets $E_1$–$E_3$ can now be set forth. Referring to FIG. 4, a chain 82 receiving power from motor D powers sprocket $E_1$. Sprocket $E_1$ is journaled to a shaft 84 transpiercing lower frame B at aperture 85. The shaft, rotatably mounted between frame sides 24, 26 drives a gear 86 in a clockwise direction.

Gear 86 drives in a counterclockwise direction gears 88, 89 of the lower rollers of rollers $F_1$, $F_2$. Lower roller of rollers $F_1$ through gear 88 having an enlarged pitch diameter, in order to increase gear backlash, drives a similar overlying roller 90 in the opposite clockwise direction. A similar gear 89 on lower roller $F_2$ drives an overlying gear 91 on upper roller $F_2$ in an identical gear arrangement and fashion. It can thus be seen that rollers $F_1$ are arranged to compress skelp therebetween and pass them to opposed rollers $F_2$.

The gearing arrangements of rollers $F_3$, $F_4$ and rollers $F_5$, $F_6$ are identical. They will not be repeated herein.

Referring to FIGS. 2 and 3, it will be seen that the output of motor D is provided with three small diameter sprockets 95, 96 and 97. These sprockets drive chains linked directly to sprocket $E_1$, $E_2$ and $E_3$ for driving roller pairs $F_1$ $F_2$; $F_3$, $F_4$; and $F_5$, $F_6$, respectively. It will be noted that the individual chain drives between motors D and the respective sprockets $E_1$–$E_3$ are offset in a vertical plane one from another. Thus, the discrete power inputs at paired opposed roller stations is provided by the configuration of this invention.

It has been previously emphasized that the roller construction of this invention enables rollers of reduced diameter to be used. This can best be illustrated with reference to FIG. 5.

Referring to FIG. 5, it will be noted that upper opposed roller 100 and lower opposed roller 102 is illustrated. Each of the rollers 100, 102 is cylindric in its dimension from end to end. The rollers are journaled at their respective ends to the shafts 22 in the case of roller 100, and 32 in the case of roller 102. This occurs at roller bearings 103, 104 for roller 100, and at roller bearings 105, 106 for roller 102. The cylindrical shapes of the rollers 100, 102 imparts to the forming rollers themselves the ability to provide the entire bending resistance necessary to corrugate skelp passing between the rollers. The concentric shafts 22 for roller 100, and 32 for roller 102 do not supply the bending resistance required to provide for the desired corrugation.

The result of this cylindric roller construction is that the diameter of the corrugating rollers is kept to a minimum. Consequently, the thickness of the corrugating mill 2—illustrated as the height of the section of FIG. 5 — is reduced. Moreover, and as can be seen in the adjacent FIG. 2, the overall length of the corrugating mill can be kept to a minimum. Compactness of the machine and the working of a correspondingly smaller segment of skelp from end to end of the machine results. Consequently, poor machine adjustment resulting in increased skelp wastage is reduced by the reduced end to end length of the roller mill here disclosed.

It has been previously described that rollers $F_6$, which are placed for the purpose of forming a precision lock seam, here shown as a Pittsburgh lock, need be independently adjustable with respect to the remainder of the rollers $F_1$–$F_5$. According to this aspect of the invention, two adjustment bolts G are provided. Bolts G penetrate and thread at their lower end into apertures 110 in side 14, and 112 in side 16. Shaft 114 on which the upper roller 116 of paired upper and lower rollers $F_6$ rides is mounted in elongate apertures 118 in side 14, and 120 in side 16. The respective bolts G penetrate into and out of non-threaded apertures 112, 124 on either end of shaft 114. As can be seen by rotation of bolts G, and by reference to the scales 127, 129, attached thereto, individual adjustment of the opposed upper and lower rollers $F_6$ towards and away from each other can be achieved.

Thus, the precision of the lock seam, here shown as a Pittsburgh lock, can be adjusted exactly and precisely.

Operation of the apparatus of this invention can now be reviewed. Commencing at the right hand portion of FIG. 1, skelp is fed into the roller mills between opposed rollers $F_1$, $F_2$. The skelp is registered by rollers 130, 132 in side to side adjustment. Rollers 130, 132 are rigidly attached to upper frame A and in slidable vertical engagement with lower frame B. Their mounting does not interfere with the towards and away movement of the respective frame sections A, B.

Referring to FIGS. 1, 2 and 7 and 9, it was previously stated that roller pair $F_6$ is individually adjustable on frame A. Roller pair $F_6$ cooperates with vertical rollers H to finish form the edge lips of the corrugated sheet. To prevent lateral sheet movements the last roller pair securely holds the sheet in a vise-like fashion, that is the spacing between the opposed surfaces of the roller is substantially equal to the actual thickness of the sheet being corrugated. No such vise-like grip is necessary between the other roller pairs $F_1$ to $F_5$ where the spacing between the opposing rollers is sufficiently large to permit expected vertical roller adjustments to maintain the overall sheet width within the desired tolerance. This requires that the spacing between such rollers is greater than the actual sheet thickness.

To effect the adjustment of rollers $F_6$, two adjustment bolts G are provided. Bolts G penetrate and thread at their lower end into apertures 110 in side 14, and 112 in side 16. Shaft 114 on which the upper roller 116 of paired upper and lower rollers $F_6$ rides is mounted in elongate apertures 118 in side 14, and 120 in side 16. The respective bolts G penetrate into and out of non-threaded apertures 122, 124 on either end of shaft 114. As can be seen by rotation of bolts G, and by reference to the scales 127, 129, attached thereto, individual adjustment of the opposed upper and lower rollers $F_6$ towards and away from each other can be achieved. Thus, the vise-like grip of rollers $F_6$ on the sheet can be maintained at all times by riasing or lowering the upper roller by an amount equal to the amount by which frame A may have been lowered or raised.

Turning now to the operation of the device of the present invention and referring to FIGS. 1, 2 and 9, flat sheet 3 is fed in a downstream direction and is registered by fixed rollers, 130, 132, (FIG. 1) which are rigidly attached to upper frame A and in slidable vertical engagement with lower frame B; or by a lateral sheet adjustment mechanism 150 (FIG. 9) which enables movement of the sheet in lateral directions to adjust its alignment with the rollers as is more fully described hereinafter.

Referring to the section of the opposed rollers $F_1$ at their contiguous juncture and proceeding through opposed rollers $F_4$, it can be seen that corrugations are formed from a position medially and longitudinally of the skelp strip outwardly. Rollers $F_1$ form a first corrugation. Rollers $F_2$ form two additional corrugations on either side of the first corrugation. Rollers $F_3$ form five corrugations, two new corrugations being added to either side. Rollers $F_4$ similarly form seven corrugations two additional corrugations being formed on either side.

It will be noted that roller $F_5$ appears to form eighth and ninth corrugations on either side of the seven corrugations from rollers $F_4$. However, the corrugations formed at the remote ends of the skelp are the beginning of the desired edge lip configuration which is later formed into a Pittsburgh lock. They are, therefore, formed with a slightly differing configuration.

Independently adjustable rollers $F_6$ cause the lateral sides of the skelp to be bent to a 90° angle and firmly grip the sheet in preparation of the final deformation of the sheet edges by vertical rollers 4. Side 140 is bent downwardly at 90°; end 142 is bent similarly at 90°.

Immediately before the corrugated skelp is formed into the helical configuration which ultimately results in corrugated pipe, it is required that the sides of the skelp be bent past center to form edge lips 9. This is accomplished by vertical axis rollers H immediately after opposed rollers $F_6$, it being noted that the vertical axis rollers H and their respective bevels, typically of 45°, are adjustable inwardly and outwardly towards the skelp with precision adjustments as is standard in the art.

After the corrugated sheet 3a leaves vertical rollers H in its finished form it travels downstream to pipe rolling station 4, where it is helically deformed into corrugated pipe 6. U.S. Pat. 3,750,439 describes in detail the construction of a pipe rolling station and the associated mechanisms. If the operator observes that the length of one or both of the edge lips 11 exceeds the stated tolerance, he can quickly take corrective action by simply turning adjustment nut 60 to raise or lower frame A relative to frame B to thereby decrease or increase, respectively, the depth of the corrugations and to thereby increase or decrease, respectively, the effective width of the sheet. Without further adjustment to vertical rollers H the length of edge lips 11 is thereby adjusted and controlled. An adjustment of the spacing between frames A, B necessitates a corresponding adjustment of vise-grip roller pair $F_6$ to maintain a constant spacing between the rollers and a firm grip on the sheet.

The task of monitoring the edge lip width and adjusting the spacing of frames A, B can be simplified and mechanized by providing a pair of edge lip monitors 152 positioned downstream of rollers H. The monitors continuously measure the width of the edge lip and if the tolerance is exceeded suitable control circuitry 154 activates a power-drive 156 which turns shaft 64 directly or via nut 60 until the measured dimension of the edge lip is within the tolerance.

For a variety of reasons such a slippage between the rollers and the sheet being corrugated, variations in the material thickness or an unevenness of non-linearity of sheet edges 11, the sheet may from time to time during the operation of the machine move off center relative to the rollers $F_1$ to $F_6$ and H. Such lateral sheet movement results in an increase of the edge lip width on one side of the sheet and a corresponding decrease in the lip width on the other side. It is apparent that even relatively small movements of the sheet may cause edge lip width variations beyond the permissible tolerance. The off center movement of the sheet cannot be corrected by simply lowering or raising frame A relative to frame B. A lateral sheet adjustment mechanism 150 is provided to compensate for lateral sheet movements and it maintains the sheets aligned with respect to the corrugating rollers to thereby maintain the width of edge lips 11 equal.

The lateral sheet adjustment mechanism generally comprises to pairs of longitudinally spaced edge rollers 158 which have a circumferential groove (not shown) which engages sheet edges 11. The rollers idle on vertical shafts 160 mounted in an upright position to sleds (not separately shown in FIG. 9). The sleds are movable perpendicular to the sheet edges on a support structure 162 and they are engaged by spindles 164 which extend perpendicular to the sheet and which are operated by a power drive 166. If a power drive is utilized it is actuated by control circuitry 154 in response to deviations in the equality of the lip edge widths.

From the above description of the construction and operation of this device it will now be clear that the present invention greatly facilitates the manufacture of corrugated, helically wound pipe from flat sheet stock by simplifying the adjustment mechanisms and operations as compared to prior art machines. In particular, a single member, namely frame A, is all that requires vertical adjustment to maintain the desired effective sheet width. The corrugating rollers can be simply and effectively mounted on fixed shafts. The heretofore necessary adjustment mechanisms for each roller, as a substitute for the adjustability of the frame and/or to provide an additional individual adjustability of the rollers which was heretofore thought necessary, has been eliminated. This greatly simplifies the construction of the device. Moreover, the lateral sheet adjustment mechanism futher simplifies the task of keeping the sheet centered relative to the rollers forming the edge lip which ultimately forms the mechanical lock seam of the finished pipe.

It will appreciated that the invention herein disclosed will admit of modification. For example, the number of rollers used can be varied. Moreover, the number of points used between the frames to provide towards and away adjustment can also be varied. Likewise, where chains and sprockets are illustrated, various types of gearing could also be substitited. Similarly, other modifications may be made to this invention without departing from the spirit and scope thereof.

We claim:

1. In a line mill having a plurality of opposed overlying and underlying working rollers for corrugating a skelp strip passing therebetween, means for forming a longitudinal edge lip extending over the length of the corrugated strip, a power source for driving the rollers to corrugate the skelp, and adjustment means for varying the working dimension between the upper and lower opposed rollers to conform to various dimensions, thicknesses and deformabilities of skelp, the improvement comprising: means for maintaining the width of the lip substantially constant, the last mentioned means including a first frame for supporting all of the overlying rollers; first shaft means fixedly carried by the first frame and mounting the overlying rollers for rotation about an axis of the first shaft means; a second frame for supporting all of the underlying rollers; second shaft means fixedly carried by the second frame and mounting the underlying rollers for rotation about an axis of the second shaft means; adjustment means for urging the first and second frame members with the respective attached overlying and underlying rollers towards one another; and means for simultaneously and identically operating the adjustment means to move the respective frame sections towards and away from one another to produce simultaneous and identical adjustment between all of the overlying and underlying rollers whereby the activation of the operating means moves the frame sections towards or away from each other to compensate for skelp strip width variations and to thereby maintain the lip width constant irrespective of such variations in the skelp width.

2. A mill according to claim 1 including an additional pair of rollers rotatably mounted to the first and second frames at a downstream end thereof, and means for moving at least one of the additional rollers relative to the associated frame towards and away from the opposing roller.

3. Apparatus for longitudinally corrugating flat sheet and for forming a longitudinal edge portion extending parallel to longitudinal edges of the sheet and having a predetermined width comprising a plurality of cooperating sets of first and second corrugating rollers for passing the sheet therebetween and corrugating it; first roller mounting means for immovably interconnecting all first rollers of the sets and for permitting the rollers to rotate about their axes; second roller mounting means for immovably interconnecting all second rollers of the sets and for permitting rotational movements of the second rollers about their axes; means for maintaining the predetermined width of the portions irrespective of variations in the actual width of the sheet, the maintaining means including means for moving the first and second interconnecting means towards and away from each other to thereby move the roller pairs of each set towards and away from each other for adjusting the depth of corrugations formed in the sheet to thereby adjust the distance between edges of the finished corrugated sheet so that the width of the portions remains constant; and means for driving the rollers to pass the sheet therebetween.

4. Apparatus according to claim 3 including pipe forming means downstream of the rollers for engaging the corrugated sheet, helically winding the sheet about a longitudinal axis to form cylindrical, corrugated pipe, and means for joining the edge portions to form a continuous pipe seam.

5. Apparatus according to claim 4 wherein the edge portions of the finish corrugated sheet define longitudinal end sections protruding transversely from a remainder of the sheet, and including means for monitoring the width of the end sections, and means cooperating with the monitoring means for moving the sheet relative to the rollers in a lateral direction to thereby equalize the width of the end sections.

6. In apparatus for forming corrugated pipe from a flat sheet, the apparatus including means for storing a roll of flat sheet; means for longitudinally corrugating the flat sheet; means for helically winding the corrugating sheet into a cylindrical form; and means for joining edges of the helically wound sheet to form an endless, helical pipe seam, the improvement to the sheet corrugating means comprising: a plurality of corrugating stations, each station being defined by first and second opposite, cooperating rollers; means for forming an edge lip extending over the length of the corrugated sheet contiguous to an edge of the sheet; first and second rigid roller support means for all first rollers and second rollers, respectively, each roller support means including means for rigidly positioning each roller relative to its support means and means permitting rotational movement of the roller about its axis; means for maintaining the width of the lip within a predetermined range irrespective of variations in the width of the flat sheet, the maintaining means including means for moving the roller support means towards and away from each other for adjusting the depth of the corrugations formed in the sheet; whereby the overall width of the finished corrugated sheet can be varied to maintain the lip width within the range by simultaneously and identically moving all first rollers towards or away from all second rollers without requiring individual roller adjustment; and means for driving the rollers to pass the sheet therebetween.

7. Apparatus according to claim 6 wherein the lip forming means forms a lip along each longitudinal edge of the sheet; wherein the seam forming means overlaps and mechanically interlocks edges of the corrugated sheet; and means for laterally adjusting the position of the sheet relative to the rollers for equalizing the widths of the lips.

8. Apparatus according to 7 wherein the lateral adjustment means comprises at least one adjustment roller disposed on each side of the sheet upstream of the corrugating roller sets and having an axis of rotation perpendicular to the sheet, the adjustment rollers engaging sides of the sheet, and means for moving the adjustment rollers perpendicular to the direction of movement of the sheet through the corrugating stations to thereby adjust the lateral position of the sheet and equalize the edge lip widths.

9. Apparatus according to claim 8 including means for monitoring the lip width, and means operatively coupled to the monitoring means for causing an automatic adjustment of the relative position of the adjustment rollers to thereby maintain an equal edge lip width on both sides of the sheet.

10. A corrugated pipe forming apparatus comprising: a plurality of first rolls and a like plurality of opposite second rolls for longitudinally passing flat sheet metal therebetween and for deforming the flat sheet into a longitudinally corrugated sheet;

means for forming lateral edge lips parallel to edges of the flat sheet metal, the lips extending over the full length of the sheet and generally transversely to a remainder of the sheet;

a pipe rolling machine including means for helically winding the corrugated sheet and means for continuously folding the lips over each other to form a mechanical lock seam securing the edges of the helically wound strip and thereby forming a continuous pipe seam defining a Pittsburg lock of predetermined dimensions and tolerances;

means for adjusting the width of the lips comprising means for simultaneously moving the rolls of each set in identical increments towards or away from each other to correspondingly change the depth of the corrugations formed in the flat sheet and to thereby correspondingly change the width of the lips, and actuating means for effecting the simultaneous and identical movement of the rolls;

whereby the widths of the lips can be continuously monitored and changed in response to variations in the sheet width or thickness to maintain the Pittsburgh lock within said dimensions and tolerances.

11. A pipe forming mill according to claim 10 including means for equalizing the widths of the lips.

12. A pipe forming mill according to claim 11 wherein the equalizing means includes means for moving the flat sheet upstream of the corrugating means in a lateral direction relative to the direction of sheet travel.

13. A pipe forming mill according to claim 12 including means for monitoring the widths of the lips, and control means operatively connected with the monitoring means and the flat sheet moving means for laterally moving the sheet in response and as a function of differences in the widths of the lips.

14. A pipe forming mill according to claim 10 including means for monitoring the width of the lips, means for operating the actuating means, and means operatively connected to the monitoring means and the operating means for moving the rollers towards or away from each other in response to changes of the lip width in excess of an admissible maximum tolerance.

15. A method for forming corrugated pipe from flat sheet metal by helically winding corrugated sheet metal and forming an interlocking seam along edges of the helically wound sheet metal, the method comprising the steps of: passing the flat sheet metal through a plurality of sets of corrugating rollers; helically deforming the corrugated sheet and cylindrically winding it about an axis which is angularly inclined relative to the direction of movement of the sheet through the corrugating rollers, the angle being a function of the pipe diameter and the corrugated sheet width; continuously interconnecting the edges of the helically wound sheet to form a continuous pipe seam; monitoring the formation of the pipe seam, and intermittently changing the width of the corrugated sheet to compensate for deviations in the width due to irregularities or dimensional changes in the flat sheet by identically moving one of the rollers of each set towards or away from the other roller of each set to thereby correspondingly change the depth of the corrugation and the overall width of the sheet.

16. A method according to claim 15 wherein the step of simultaneously and identically moving the rollers comprises the step of operating a single adjustment member, and transmitting the movement of the adjustment member to all affected rollers.

17. A method according to claim 15 wherein the step of forming a seam along the edges of the helically wound corrugated sheet comprises the step of forming a continuous lip along each side of the sheet, overlapping the lips after the sheet has been helically wound, and mechanically interlocking the lips to form a mechanical lock seam; and wherein the step of changing the width of the sheet comprises the step of maintain the width of each lip constant and at a predetermined magnitude irrespective of changes or variations in the width or thickness of the sheet by simultaneously and identically moving a roller of each roller set towards or away from the other roller of the set to correspondingly change the depth of the corrugations in the sheet.

18. A method according to claim 17 including the step of equalizing the width of both lips by moving the sheet upstream of the corrugating rollers in a direction perpendicular to the direction of movement of the sheet through the rollers until equality of the lip widths is attained.

19. A method according to claim 18 including the step of continuously monitoring the widths of the lips, and including the steps of moving the sheet in a lateral direction and moving the rolls towards or away from each other ot maintain the lip widths within said tolerance and equal to each other.

* * * * *